US007380403B2

(12) United States Patent
Smah et al.

(10) Patent No.: US 7,380,403 B2
(45) Date of Patent: Jun. 3, 2008

(54) HEAT EXCHANGE DEVICE FOR A COLD-PRODUCING MACHINE

(75) Inventors: Michel Smah, Sathonay-Village (FR); Mohamed Ali Ben Lakhdhar, Bourgoin-Jallieu (FR); David Liope, Diemoz (FR); Gerard Blain, Mions (FR); Alain Compingt, Grezieu la Varenne (FR)

(73) Assignee: LGL France, Mions (FR)

( * ) Notice: Subject to any disclaimer, the term of this patent is extended or adjusted under 35 U.S.C. 154(b) by 244 days.

(21) Appl. No.: 11/167,932

(22) Filed: Jun. 28, 2005

(65) Prior Publication Data

US 2006/0021371 A1 Feb. 2, 2006

(30) Foreign Application Priority Data

Jun. 29, 2004 (FR) ..... 04 07113

(51) Int. Cl.
*F25C 1/14* (2006.01)

(52) U.S. Cl. ..... 62/71; 165/94; 62/354

(58) Field of Classification Search ..... 62/354, 62/71; 165/94
See application file for complete search history.

(56) References Cited

U.S. PATENT DOCUMENTS 2,054,841 A 9/1936 Taylor
3,191,398 A * 6/1965 Rader ..... 62/138
3,488,974 A * 1/1970 Johnson et al. ..... 62/123
4,059,047 A 11/1977 Sollich et al.
4,271,682 A 6/1981 Seki et al.
4,527,401 A * 7/1985 Nelson ..... 62/354
4,669,277 A * 6/1987 Goldstein ..... 62/354
4,796,441 A 1/1989 Schneller
7,052,728 B2 * 5/2006 Kateman et al. ..... 426/515

FOREIGN PATENT DOCUMENTS

WO 85/03996 9/1985

* cited by examiner

*Primary Examiner*—William E. Tapolcai
(74) *Attorney, Agent, or Firm*—Dennison, Schultz & MacDonald

(57) ABSTRACT

The invention relates to a heat exchange device including at least one heat exchange wall (6) between the refrigerant fluid (3) and the fluid to be cooled (4) having on one side a so-called hot surface (7) in contact with the fluid to be cooled, and at least one mechanical system (10) antagonist to the deposition on the hot surface of the exchange wall, of a solid layer of the fluid to be cooled. According to the invention, the means antagonist to the deposition is formed with a friction means (11) including a planar surface extending parallel to the hot surface of the exchange wall and having a heat conductivity such that the ratio of the heat conductivities of said friction means on the hot surface is larger than or equal to 3, and the mechanical system (10) includes means for supporting the friction means, adapted so that the latter rubs on the hot surface of the exchange wall via its planar surface.

12 Claims, 2 Drawing Sheets

HEAT EXCHANGE DEVICE FOR A COLD-PRODUCING MACHINE

BACKGROUND OF THE INVENTION

The present invention relates to the technical field for producing cold by applying at least one heat exchanger between a fluid to be cooled or a secondary refrigerant and a refrigerant fluid flowing in one or more units to be cooled of any nature.

More specifically, the present invention relates to the indirect exchange of heat between a refrigerant fluid or refrigerant during vaporization on the one hand and, a fluid to be cooled to the limit of solidification on the other hand, such as a fluid comprising two phases of a same body in melting equilibrium, i.e., comprising a liquid phase and a solid phase, such as for example water added with an antifreeze agent such as salt, alcohol, monoethylene glycol or monopropylene glycol so that its crystallization point is less than 0° C.

In the state of the art, many embodiments of cold-producing machines are known which apply a biphasic fluid to be cooled consisting of a homogenous mixture of liquid and solid phases. For example, Patent EP 0 257 936 describes a cold-producing machine comprising a heat exchange device, formed with a series of exchangers of the type with plates. Each exchanger includes at least one heat exchange wall between the refrigerant fluid and the fluid to be cooled, each flowing in independent circuits. Each heat exchange wall has on one side, a first so-called hot surface in contact with the fluid to be cooled and, on the other side, a second so-called cold surface in contact with the refrigerant fluid.

In order to prevent deposition of a solid layer of the fluid to be cooled, on the first surface of the exchange wall, a doctor blade acting as a mechanical means antagonist to the deposition of this solid layer is displaced in rotation relatively to this first surface. This blade has a sawtooth shape, complementary to the first surface of the heat wall conformed with corrugations.

In practice, the manufacturing processes for the doctor blade and the first surface of the exchange wall proves to be delicate to achieve while having a prohibitive cost. Moreover, insofar as the doctor blade is mounted on a return spring system, a solid layer is able to subsist on the surface of the exchange wall. This scraping effect is all the more reduced since a solid deposit also appears on the doctor blade.

In the same sense, document WO 85/03996 describes a heat exchange device notably including at least one heat exchange wall between a refrigerant fluid and a fluid to be cooled. A beveled or tapered blade in order to exhibit a cutting edge, acts on the heat exchange wall in contact with the fluid to be cooled so as to remove the ice which forms on such a wall. Such a device applying a doctor blade has the same drawbacks as the device described by Patent EP 0 257 936.

SUMMARY OF THE INVENTION

The present invention is therefore directed to finding a remedy to the drawbacks stated above by proposing a heat exchange device having a simple design and a reduced manufacturing cost, while being designed to prevent the formation of a solid layer, on the surface of the heat exchange wall in contact with the fluid on the one hand and on the means antagonist to the deposition of such a solid layer on the other hand.

To achieve such a goal, the heat exchange device between a refrigerant fluid on the one hand and a fluid to be cooled on the other hand, includes:

- at least one heat exchange wall between the refrigerant fluid and the fluid to be cooled, each flowing in independent circuits, the heat exchange wall having on one side, a so-called hot surface in contact with the fluid to be cooled and on the other side, a so-called cold surface in contact with the refrigerant fluid,
- at least one mechanical system antagonist to the deposition on the hot surface of exchange wall, of a solid layer of the fluid to be cooled, such a mechanical system including at least one means antagonist to the deposition capable of being displaced in rotation relatively to the hot surface.

According to the invention:

- the deposition antagonist means is formed with a friction means including a planar surface extending parallel to the hot surface of the exchange wall and having a heat conductivity such that the ratio of the heat conductivities of said hot surface on the friction means is larger than or equal to 3, and preferably between 20 and 50,
- the mechanical system includes means for supporting the friction means, adapted so that the latter rubs on the hot surface of the exchange wall, via its planar surface.

According to an advantageous embodiment feature, the planar surface of the friction means has a width between 30 and 120 mm and preferably of the order of 40 mm substantially.

According to a first alternative embodiment, the friction means is formed with a wiping arm having the planar surface delimited by at least one beveled edge and rotationally mounted around a rotor while being actuated by pressure means in order to form the mechanical system.

According to this alternative embodiment, the wiping arm has a planar friction surface made in a material having a friction coefficient between 0.01 and 0.3.

According to another alternative embodiment, the friction means includes a planar surface formed with a spongy absorbent material for the fluid to be cooled, in order to retain a solid layer of the fluid to be cooled, intended to rub on the hot surface of the exchange wall.

According to this alternative, the mechanical system includes an arm rotationally mounted around a rotor and fitted with an absorbent means.

Advantageously, the arm or the wiping means is rotationally mounted around an axis extending substantially perpendicularly to the heat exchange wall which extends in a plane.

Preferably, the heat exchange device includes at least one second heat exchange wall.

Advantageously, the heat exchange walls are formed with at least one pair of disks which extend at a distance from each other while being closed at their periphery in order to form an enclosure being part of the circulation circuit for the fluid to be cooled.

Another object of the invention is directed to a cold-producing machine including at least one heat exchange device according to the invention.

Another object of the invention is directed to propose a method for opposing the deposition of a solid layer of a fluid to be cooled, likely to appear on a so-called hot surface in contact with the fluid and extending on one side of a heat exchange wall between the fluid to be cooled and a refrigerant fluid, the other side of the heat exchange wall having a so-called cold surface in contact with the refrigerant fluid. The method according to the invention is directed to provide wiping of the hot surface by friction means including a planar surface rubbing on said hot surface, the ratio of the heat conductivities of said hot surface on the friction means being larger than or equal to 3, and preferably between 20 and 50.

BRIEF DESCRIPTION OF THE DRAWINGS

Various other features will become apparent from the description made below with reference to the appended drawings which show, as non-limiting examples, embodiments of the object of the invention.

DESCRIPTION OF THE PREFERRED EMBODIMENTS

Figure 1:
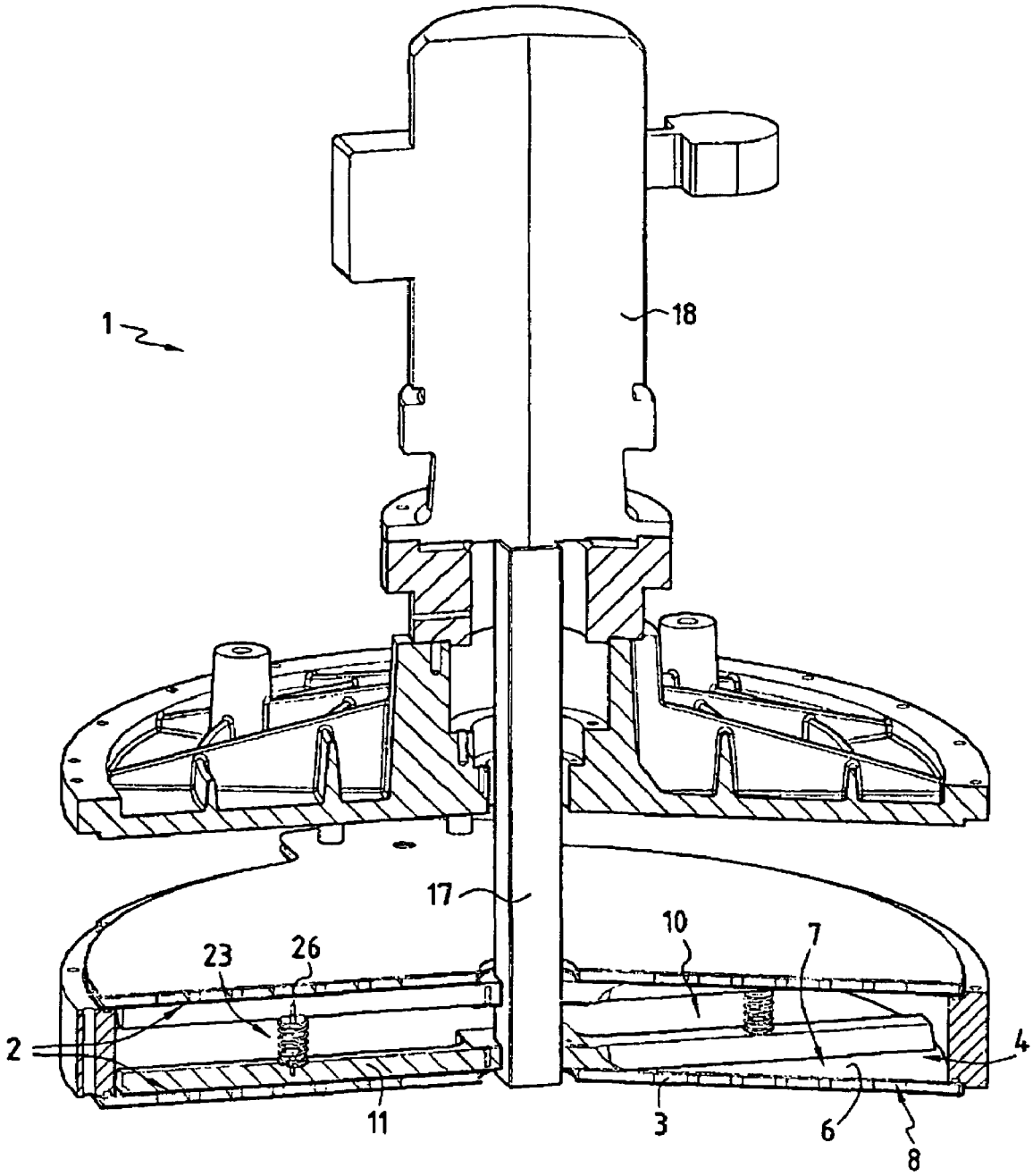
FIG. 1 is a partial perspective half-view of a cold producing machine according to the invention.

As it is more specifically apparent from FIG. 1, the object of the invention relates to a machine 1, with which cold may be produced and including at least one, and generally a series of heat exchange devices 2 allowing indirect exchange of heat between a refrigerant fluid 3, for example ammonia during vaporization on the one hand and a fluid to be cooled 4 to the limit of solidification on the other hand, such as for example water for which the freezing point has been lowered. The refrigerant fluid 3 and the fluid to be cooled 4 each flow in independent circuits, not shown in their entirety.

It should be considered that the object of the invention is more specifically directed to the heat exchange device 2 being part of a cold-producing machine which will not be described more specifically to the extent that its structure belongs to standard technical knowledge. In the example illustrated in the drawings, the cold-producing machine includes a series of heat exchange devices 2 stacked on each other, each having a circular shape. Of course, the object of the invention is applied to different embodiments of heat exchange devices.

Each heat exchange device 2 includes at least one heat exchange wall 6 between the refrigerant fluid 3 and the fluid to be cooled 4. This heat exchange wall 6 has on one side, a first co-called hot surface 7 in contact with the fluid to be cooled 4 and, on the other side, a second so-called cold surface 8 in contact with the refrigerant fluid 3.

Each heat exchange device 2 also includes at least one mechanical system 10 antagonist to the deposition on the first surface 7, of a solid layer of the fluid to be cooled 4. Such a mechanical system 10 includes at least one means 11, antagonist to the deposition of a solid layer capable of being displaced in rotation relatively to the hot surface 7.

Figure 2:
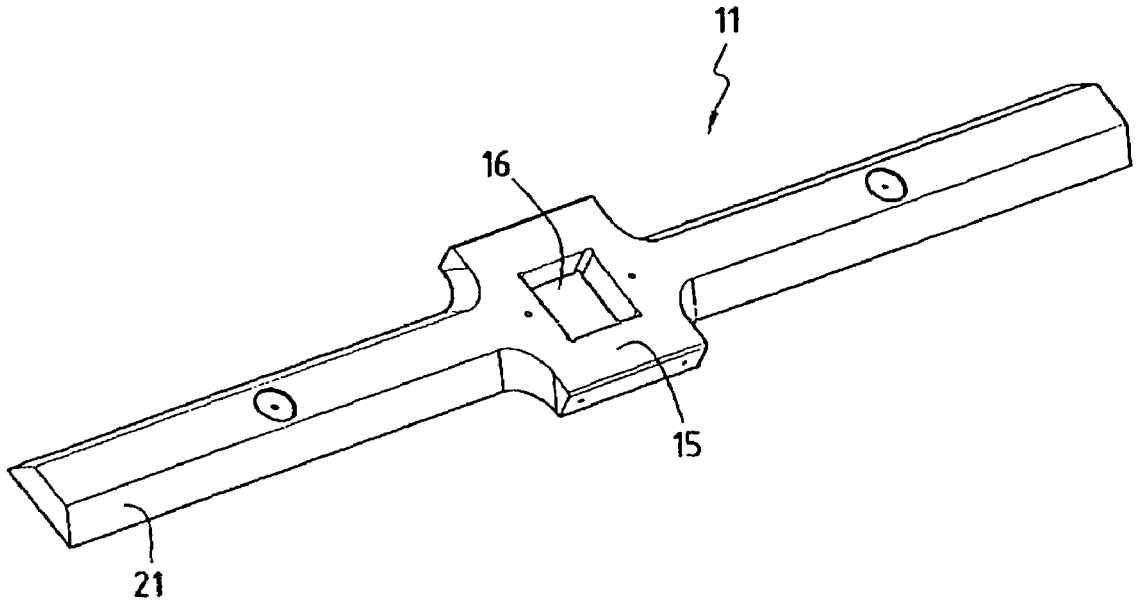
FIG. 2 is a perspective view showing a characteristic detail being part of the object of the invention.
Figure 3:
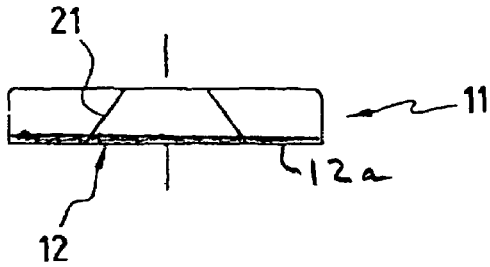
FIG. 3 is an end view of the device illustrated in FIG. 2.

According to the invention, the deposition antagonist means 11 is formed with friction means including, as this is more specifically apparent from FIGS. 2, 3, a planar surface 12 extending parallel to the hot surface 7 of the exchange wall. It should be understood that the planar surface 12 has sufficient and suitable dimensions in order to provide a rubbing or wiping function on the hot surface 7. According to an advantageous embodiment feature, the planar surface 12 which rubs on the hot surface 7 has a width between 30 and 120 mm and preferably of the order of 40 mm substantially. Of course, the planar surface 12 is made so that during its displacement, it may rub on the totality of the hot surface 7, as this will subsequently be explained in the description.

According to the invention, this friction means 11 has a heat conductivity such that the ratio of the heat conductivities of the hot surface 7 on the friction means 11 is larger than or equal to 3, and preferably, between 20 and 50, and advantageously equal to 40, substantially. To reach such a heat conductivity ratio, provision may be made for using as a constitutive material of the friction means 11 and of the hot surface 7, for example, HDPE 500 (High Density Polyethylene) and stainless steel, respectively.

In the embodiment more particularly illustrated in FIGS. 2 and 3, the friction means 11 is formed with a wiping arm having two aligned branches, connected to a central body 15 used for mounting a means 16 for driving the wiping arm into rotation. In the illustrated example, the central body 15 is provided with a prismatic bore as a driving means 16, providing the passage for an output shaft 17 of a motor 18 of any known type. The output axis 17 thus extends perpendicularly to the wiping arm 11, i.e., also to the heat exchange wall 6, the hot surface 7 of which is of a circular shape. The wiping arm has a length substantially equal to the diameter of the hot surface 7 so as to rub on the totality of the hot surface, because of its being driven into rotation.

In the illustrated example, the wiping arm 11 has a planar surface 12 delimited by at least one beveled edge 21 and, preferably, by two beveled edges extending with mirror symmetry relatively to the extensional longitudinal axis of the wiping arm.

According to another feature of the invention, the wiping arm 11 has a planar friction surface made in a material having a friction coefficient between 0.01 and 0.3. For example, such a wiping means is made in HDPE 500.

According to another feature of the invention, the mechanical system 10 includes means for supporting the friction means 11, adapted so that the latter rubs on the hot surface 7 of the exchange wall via its planar surface 12. In the illustrated example, the mechanical system 10 includes pressure means 23 with which rubbing of the wiping arm on the hot surface 7 is provided.

According to a preferred embodiment feature, the cold-producing machine according to the invention includes an even number of heat exchange devices 2, the heat exchange walls 6 of which are placed in a superimposed way, with respect to each other, so that both hot surfaces 7, placed facing each other, are provided with friction means 11 which press against said hot surfaces 7, by common pressure means 23.

In the illustrated example, two neighbouring wiping arms 11 are held by pressure means 23 formed with springs each mounted around a linking rod 26 mounted between both neighbouring wiping arms 11. According to this embodiment, each heat exchange device 2 includes two heat exchange walls 6 positioned close each other so as to delimit a closed enclosure for the flow of the fluid to be cooled 4. Also, provision may be made for positioning close each other, two heat exchange walls 6 so as to delimit between the so-called cold surfaces 8 of said walls, a closed enclosure for the refrigerant fluid 3.

According to another embodiment, the planar surface 12 of the friction means 11 may be formed with a spongy absorbent material 12*a* for the fluid to be cooled 4, as shown in FIG. 3. With such an absorbent spongy material, it is possible to retain a solid layer of the fluid to be cooled 4. This solid layer thus rubs on the hot surface 7 of the exchange wall to prevent deposition of a solid layer on the hot surface 7.

It is apparent from the foregoing description that the object of the invention is directed to describing a new method for opposing deposition of a solid layer of a fluid to be cooled, on the hot surface of the heat exchange wall. Such a method is directed to provide wiping of the hot surface by friction means having a planar surface, the heat conductivity of which allows deposition of a solid layer to be prevented both on the hot surface and on the friction means. The method according to the invention is thus directed to wiping the hot surface and not to scraping it by means of a beveled blade as proposed by the prior solutions.

The invention is not limited to the described and illustrated examples as various changes may be provided thereto without departing from its scope.

What is claimed is:

1. A heat exchange device for exchanging heat between a refrigerant fluid and a fluid to be cooled to a solidification limit, the heat exchange device including:

a first fluid flow circuit containing the refrigerant fluid;

a second fluid flow circuit containing the fluid to be cooled to the solidification limit and independent of the first fluid flow circuit;

at least one heat exchange wall disposed between the first and second fluid flow circuits, the heat exchange wall having a first, cold surface in contact with the refrigerant fluid, and an opposite, hot surface in contact with the fluid to be cooled; and at least one mechanical system to prevent deposition on the hot surface of a solid layer of the fluid to be cooled, the mechanical system comprising a friction means having a planar surface extending parallel to the hot surface, means for supporting the friction means constructed and arranged such that the planar surface is in frictional contact with the hot surface, and means for displacing the friction means in rotation relative to the hot surface to scrape the hot surface, wherein the planar surface has a width between 30 and 120 mm, and the hot surface and the friction means have heat conductivities in a ratio of the heat conductivity of the hot surface to the heat conductivity of the friction means of at least 3.

2. The device according to claim 1, wherein the heat conductivity ratio is between 20 and 50.

3. The device according to claim 1, wherein the width of the planar surface is about 40 mm.

4. The device according to claim 1, wherein the friction means is formed with a wiping arm and the planar surface is delimited by at least one beveled edge, the friction means being rotationally mounted around a rotor and actuated by pressure means to form the mechanical system.

5. The exchange device according to claim 4, wherein the wiping arm has a planar surface made of a material having a friction coefficient between 0.01 and 0.3.

6. The exchange device according to claim 1, wherein the planar surface is formed with a spongy absorbent material, so as to retain thereon a solid layer of the fluid to be cooled to rub on the hot surface.

7. The exchange device according to claim 1, wherein the mechanical system includes a rotor and an arm rotationally mounted around the rotor, and fitted with an absorbing means.

8. The exchange device according to claim 7, wherein the arm is rotationally mounted around an axis extending substantially perpendicularly to the hot surface, which extends in a plane.

9. The exchange device according to claim 1, additionally comprising at least one second heat exchange wall.

10. The exchange device according to claim 9, wherein the heat exchange walls are formed by disks extending at a distance from each other and closed at their periphery in order to form an enclosure for the fluid flow circuit for the fluid to be cooled.

11. A cold-producing machine including at least one heat exchange device according to claim 1.

12. In a heat exchange device, a method for preventing deposition of a solid layer of a fluid to be cooled on a hot surface in contact with the fluid to be cooled, the hot surface extending on one side of a heat exchange wall between the fluid to be cooled and a refrigerant fluid, an opposite side of the heat exchange wall having a cold surface in contact with the refrigerant fluid, comprising wiping the hot surface by a friction means including a planar surface rubbing on the hot surface, the heat conductivities of the friction means and the hot surface being in a ratio of at least 3, the planar surface having a width of between 30 and 120 mm.

* * * * *